United States Patent [19]

Crist et al.

[11] Patent Number: 4,709,760

[45] Date of Patent: Dec. 1, 1987

[54] CEMENTING TOOL

[76] Inventors: Wilmer W. Crist, 110 Teche Dr.; Dan Firmin, 215 Camelia Blvd., both of Lafayette, La. 70503

[21] Appl. No.: 314,356

[22] Filed: Oct. 23, 1981

[51] Int. Cl.[4] ..... E21B 43/11; E21B 33/13

[52] U.S. Cl. ..... 166/285; 166/55.1; 166/297; 166/317; 175/4.54

[58] Field of Search ..... 166/55.1, 55, 63, 297, 166/295, 289, 154, 155, 156, 317, 318, 253; 175/4.56, 4.54; 102/319

[56] References Cited

U.S. PATENT DOCUMENTS

| | | | |
|---|---|---|---|
| 1,941,406 | 12/1933 | Manning | 166/154 |
| 2,169,568 | 8/1939 | Morrisett | 166/154 |
| 2,749,840 | 6/1956 | Babcock | 175/4.6 |
| 2,760,408 | 8/1956 | Taylor | 175/4.54 |
| 3,713,490 | 1/1973 | Watson | 166/318 |
| 4,499,951 | 2/1985 | Vann | 166/297 |

*Primary Examiner*—James A. Leppink
*Assistant Examiner*—Hoang C. Dang
*Attorney, Agent, or Firm*—David L. Ray

[57] ABSTRACT

A method and apparatus for cementing an oil or gas well casing including a tubular body section for placing in an oil or gas well casing, the tubular body section being connectable at its upper end to a string of drill pipe and at its lower end to a perforating gun, the tubular body section having a hollow interior, a plurality of upper ports, and a plurality of lower ports, a sliding sleeve located inside the tubular body section adapted to permit drilling fluids to be pumped therethrough and out of the lower ports and to slide downwardly in response to pressure applied to the interior of the string of drill pipe when a seal is placed in contact with the sliding sleeve and thereby activate the perforating gun to perforate the casing, close the lower ports, and open the upper ports to permit cement or other fluids to be pumped outwardly through the upper ports.

24 Claims, 3 Drawing Figures

CEMENTING TOOL

BACKGROUND OF THE INVENTION

This invention relates to oil well equipment and particularly to a cementing tool which is connected to a conventional perforating gun.

In conventional drilling operations, a gun perforater is used to perforate the casing in order to produce oil and/or gas at a specific depth. However, after a period of time has elapsed, gas in commercial quantities may no longer be available for production from the formation and it may be desirable to completely seal the area perforated and to perforate the casing at some point above the sealed area in the hope of realizing oil andor gas production from another zone.

To achieve a strong, high pressure seal, cement is pumped into the casing to seal the perforated area. To achieve the best seal, it is necessary to again perforate the area previously perforated to make larger and more numerous holes in the casing which facilitates the flow of cement into the area immediately around the perforated area both inside and outside of the casing.

Prior to the present tool being developed, it was necessary to run a gun perforater down a wire line to re-perforate the area to be sealed. After the re-perforation, the perforating gun was pulled out of the hole and another string of pipe was run in to force cement into the area which was desired to be sealed. Such an operation was costly and time consuming.

The following patents are relevant because they show methods and apparatus for effecting a dual completed well and various perforating devices and methods: U.S. Pat. Nos. 3,706,344; 3,450,203; 2,970,647; 2,876,843; 2,760,408; and 2,307,360.

SUMMARY OF THE INVENTION

In accordance with the present invention there is provided a method and apparatus for re-perforating a casing which has been previously perforated, and cementing the re-perforated area. The method and apparatus includes a cementing tool connected at its upper end to a string of drill pipe and at its lower end to a gun perforator, the tool including a tubular body section, the body section pipe including a series of top circulating ports and a series of bottom circulating ports for allowing fluids to circulate therethrough, a first sliding sleeve member connected to said body section by a series of shear pins, the sleeve having a hollow port in the center thereof through which drilling fluids may flow, the first sliding sleeve having a plurality of firing pins located at the bottom thereof for detonating explosive cartridges located in the body section, a second sliding sleeve located in the bottom of said body section, said second sliding sleeve being connected to said section by shear pins, the second sliding sleeve containing explosive cartridges for detonating or triggering the perforating gun.

THE INVENTION

Figure 1:
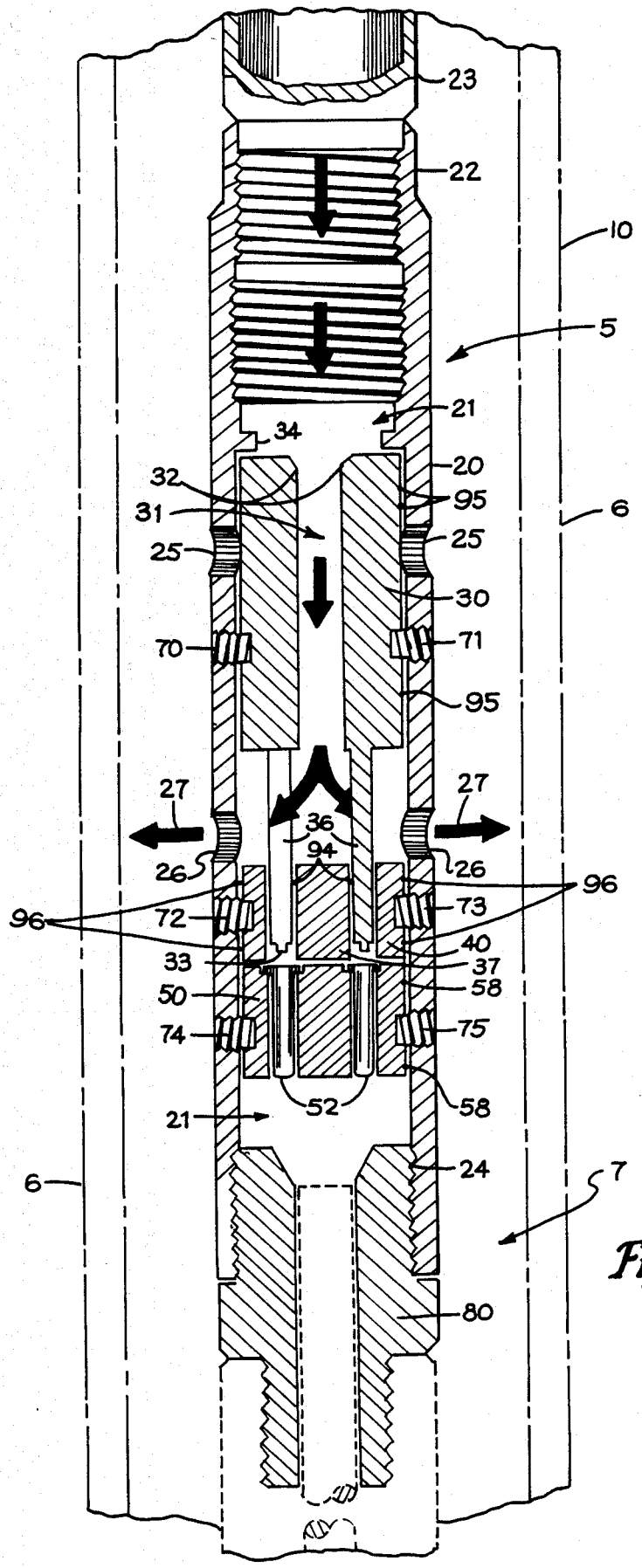
FIG. 1 is a cross-sectional, partly cut away, side elevational view of the tool of the invention in the position in which drilling mud is being circulated threrethrough.

Referring now to the drawings, the cementing tool of the present invention can be seen in FIG. 1 to be generally indicated by the numeral 5. The tool is shown located inside of a casing 6. The open area inside casing is indicated by the numeral 7 and is commonly referred to as the bore.

The tool 5 is connected at its top end to a pipe 23 by threads 22. Pipe 23 may be a drill pipe or any type of steel pipe used in drilling operations.

The tool 5 includes a tubular body section 20 which has a circular cross section and is hollow inside. Located on the wall of body 20 are a plurality of upper ports 25 through which fluids may be circulated from the interior of tool 5 to the exterior thereof, and a plurality of lower ports 26 through which fluids may also be circulated as indicated by the arrows 27.

Located in the upper portion of tool 5 and in the interior of body 20 is first sliding sleeve 30. Sliding sleeve 30 is initially held in a stationary position by a plurality of shear pins such as those indicated at 70 and 71, which are mounted in the wall of body 20 and extend inwardly into sliding sleeve 30 as indicated in drawings. A series of conventional circular seals 95 are placed between sliding sleeve 30 and the interior wall of body 20. The seals 95 prevent fluids from flowing between the outside of sliding sleeve 30 and the interior wall of body 20.

A seat 32 is located at top of sliding sleeve 30 which is circular in cross section. Seat 32 is tapered to receive ball 60 shown in FIGS. 2 and 3 and form a high pressure seal therewith. Immediately beneath the seat 32 is channel 31 which is circular in cross section and permits fluids to flow downwardly therethrough as indicated by the arrows.

Located at the lower end of sliding sleeve 30 and rigidly connected thereto are a plurality of firing pins 36. The firing pins 36 correspond in number to the explosive cartridges 52 aligned therewith beneath the firing pins. The pins are preferably round rods having tips 33 thereon which strike cartridges 52 causing cartridge 52 to explode and detonate a conventional gun perforator generally indicated by the numeral 80. Perforator 80 is connected to the lower end of tool 5 by threads 24. Such gun perforaters are well known in the art and typical gun perforator are disclosed in the previously cited patents.

The upper movement of first sliding sleeve 30 is limited by shoulder 34. Shoulder 34 is located immediately above sliding sleeve 30. Shoulder 34 can be a continuous ring extending from the inside of body 20 or it may be a series of projections extending inwardly from the body 20.

Figure 2:
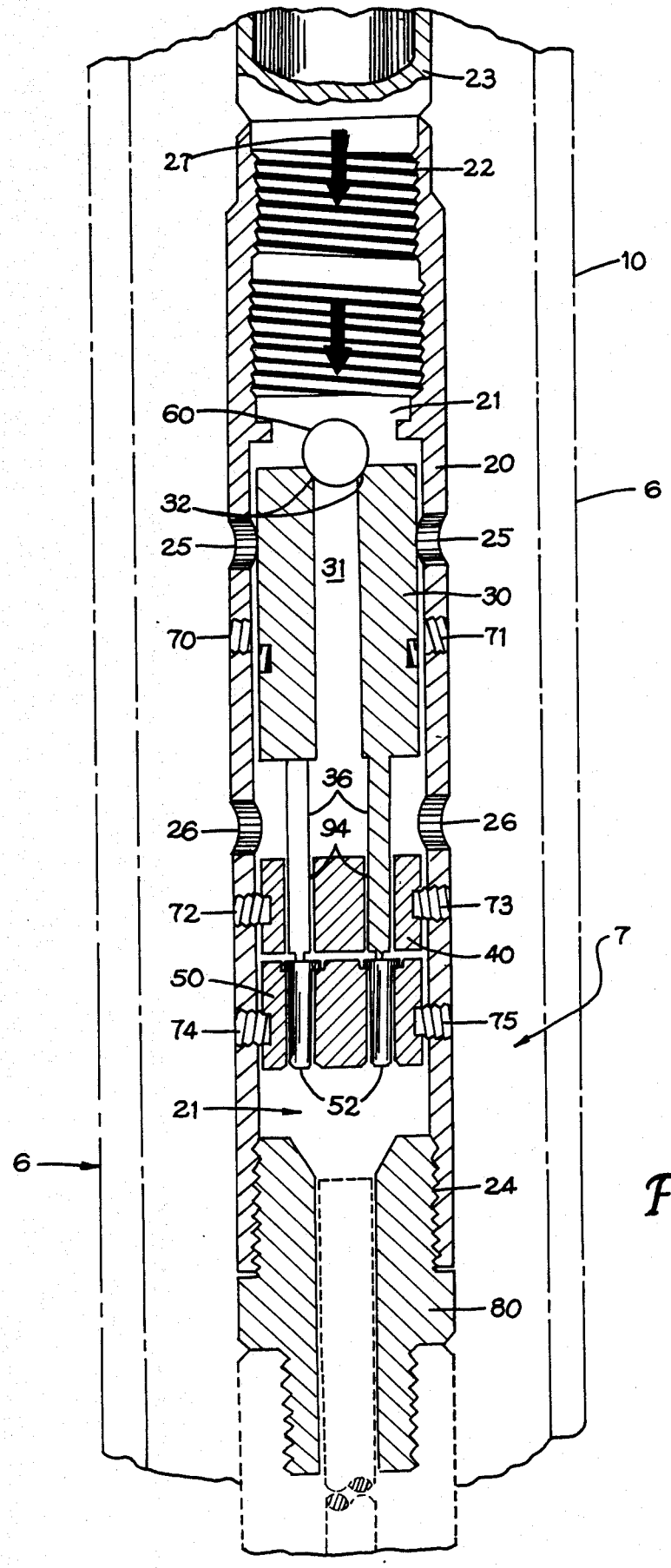
FIG. 2 is a cross-sectional, partly cut away, side elevational view of the tool of the invention after the sealing means has been placed therein and the explosive cartridges are being detonated; and, FIG. 3 is a cross-sectional, partly cut away, side elevational view of the invention in which the cartridges have been fired and the sliding sleeve is in the bottom position thereby permitting cement to be pumped into the casing.
Figure 3:
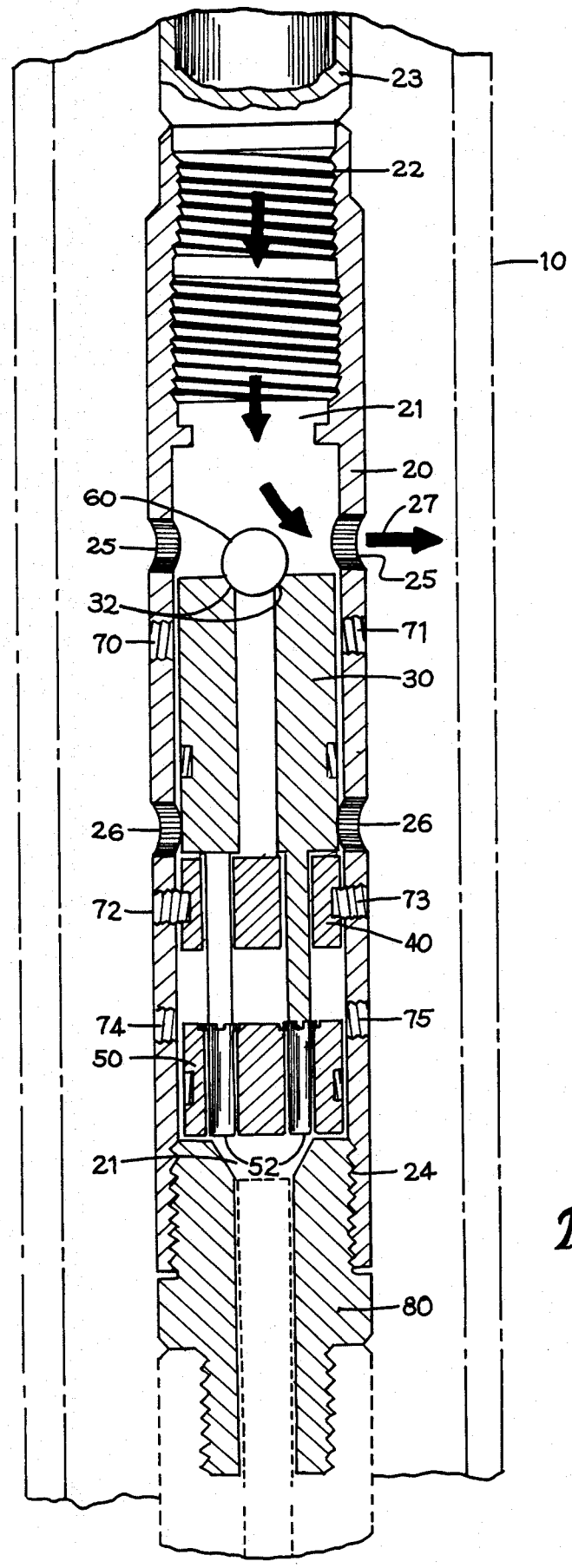

Firing pins 36 are shown in FIGS. 1, 2 and 3 as being received within channels 37 located in guide member 40. Seals 94 between firing pins 36 and the inside walls of channels 37 prevent fluids under pressure from escaping there between. Guide 40 is connected to outside wall 20 by a series of pins 72 and 73 which may be two or more in number. These pins will not normally shear and hold guide 40 rigidly in place. Seals 94 prevent any escape of fluids under pressure between the inside wall of body 20 and guide 40.

Located beneath the guide 40 is second sliding sleeve 50. Second sliding sleeve 50 contains a series of cartridges 52 therein which correspond in number to firing pins 36 and are aligned immediately therebeneath. Second sliding sleeve 50 is connected to outside wall 20 by a plurality of pins 74 and 75 which may be more than two in number. The pins 74, 75 are designed to shear when first sliding sleeve 30 forces firing pins 36 into contact therewith. Initially, as firing pins 36 and their tips 33 strike cartridges 52, the cartridges explode and thereby trigger perforating gun 80 to perforate casing 6. However, as sliding sleeve 30 continues downwardly, firing pins 36 force the cartridges and second sliding sleeve 50 downwardly to the position indicated in FIG. 3. Seals 54 prevent any fluids from flowing around the outside of second sliding sleeve 50.

The tool of the present invention operates in the following manner. As shown in FIG. 1, the tool has been lowered to the zone or level which is desired to be plugged. Fluids are then circulated downwardly through pipe 23 and outwardly through ports 26 as indicated by the dark arrows 27. The fluids are conventional drilling fluids commonly referred to as drilling mud. The fluid is circulated for a time sufficient to prepare the bore for perforation.

When it is desired to fire the perforating gun 80 located at the bottom of the tool 5, a ball 60 is dropped into pipe 23 at the surface of the ground and falls downwardly through pipe 23 to the position shown in FIG. 2. Thus, ball 60 rests on seat 32, thereby sealing channel 31 and preventing any fluids from flowing outwardly through body 20. After pressure testing the pipe 23, a higher pressure is applied to the interior of the pipe 23, to force sliding sleeve 30 downwardly onto cartridges 52 as shown in FIG. 2. When tips 33 on firing pin 36 strike cartridges 52, cartridges 52 explode and cause gun perforater 80 to explode and perforate the casing. As sliding sleeve 30 continues to move downwardly, sliding sleeve 30 will shear the pins indicated by the numerals 74 and 75 holding the second sliding sleeve 50, thereby causing sliding sleeve 30 to continue downwardly, thereby permitting ports 25 to communicate with the interior 21 of tool 5 above sliding sleeve 30.

Thus, as shown in FIG. 3, cement for sealing the hole can flow downwardly from the surface through pipe 23 into body 20 and out through ports 25 to cement the area of the casing which is desired to be sealed. After sufficient cement flows into the bore hole, the tool is moved upwardly while the cement is wet so the cement can completely seal off the casing. Excess cement can be removed though pipe 23 by applying pressure to the outside of pipe 23. After the cement is allowed to dry the tool can be dropped down on the top of the cement to indicate the depth of the top of the cement. Furthermore, pressure can be applied through the tool after the cement is dry to determine whether the hole has been sufficiently cemented. After cementing, other areas can be perforated above the cement for drilling.

Although the preferred embodiments of the present invention have been disclosed and described in detail above, it should be understood that the invention is in no sense limited thereby, and its scope is to be determined by that of the following claims.

What is claimed is:

1. An apparatus for cementing an oil or gas well casing comprising:

a. a tubular body section for placing in an oil or gas well casing, said tubular body section being connectable at its upper end to a string of drill pipe and at its lower end to means for perforating an oil or gas well casing, said tubular body section having;
(i) a hollow interior;
(ii) a plurality of upper port means;
(iii) a plurality of lower port means;

b. a sliding sleeve means having firing pin means connected thereto, said sliding sleeve means being located inside said tubular body section, said sliding sleeve means being adapted to permit drilling fluids to be pumped therethrough and out of said lower ports and to slide downwardly in response to pressure applied to the interior of said string of drill pipe when seal means are placed in contact with said sliding sleeve means and thereby
(i) activate said means for perforating an oil or gas well casing to perforate said casing,
(ii) close said lower ports, and
(iii) open said upper ports to permit cement or other fluids to be pumped outwardly through said upper ports.

2. The apparatus of claim 1 wherein said seal means is a sphere.

3. The apparatus of claim 2 wherein said sliding sleeve means has a channel therein for conveying said drilling fluids therethrough.

4. The apparatus of claim 3 wherein said channel has seat means at the upper end thereof for receipt of said sphere.

5. The apparatus of claim 1 wherein said sliding sleeve means is connected to said tubular body section by shear pin means.

6. The apparatus of claim 5 wherein, prior to shearing said shear pin means, said sliding sleeve means covers said upper ports and said lower ports are uncovered.

7. The apparatus of claim 1 wherein a second sliding sleeve means is located in said tubular body section beneath said first sliding sleeve means, said second sliding sleeve containing means for activating said means for perforating.

8. The apparatus of claim 7 wherein said means for activating is an explosive charge.

9. The apparatus of claim 8 wherein said explosive charge is a rifle or pistol cartridge.

10. The apparatus of claim 7 wherein said second sliding sleeve means is connected to said tubular body section by shear pin means.

11. The apparatus of claim 7 wherein said second sliding sleeve means has seal means thereon.

12. The apparatus of claim 1 wherein said sliding sleeve means has seal means thereon which forms a fluid seal around said sliding sleeve means.

13. The apparatus of claim 7 whererin a guide means is located between said first sliding sleeve means and said second sliding sleeve means.

14. The apparatus of claim 13 wherein said guide means is rigidly connected to said tubular body section.

15. The apparatus of claim 14 wherein the top of said guide means is located beneath said lower ports.

16. The apparatus of claim 14 wherein said guide means has channel means therein for receipt of firing pin means located on the bottom of said first sliding sleeve means.

17. The apparatus of claim 16 wherein said guide means has seal means on the outside thereof and in said channel means which form a fluid seal.

18. A method for cementing an oil or gas well casing comprising:

A. connecting a cementing tool to the end of a drill pipe, said cementing tool having
   a. a tubular body section having an upper end and a lower end, and
   (i) a hollow interior;
   (ii) a plurality of upper port means;
   (iii) a plurality of lower port means;
   (iiii) a means for perforating an oil or gas well casing connected to said lower end of said tubular body section;
   b. a sliding sleeve located inside said tubular body section adapted to permit drilling fluids to be pumped therethrough and out of said lower ports and to slide downwardly in response to pressure applied to the interior of said string of drill pipe when seal means are placed in contact with said sliding sleeve and thereby
   (i) activate said means for perforating an oil or gas well casing to perforate said casing,
   (ii) close said lower ports, and
   (iii) open said upper ports to permit cement or other fluids to be pumped outwardly through said upper ports, B. lowering said cementing tool into said casing to the area of the casing to be cemented, C. sealing the upper end of said sliding sleeve, D. applying sufficient pressure to the inside of said drill pipe to force said sliding sleeve downwardly a distance sufficient to
   (i) activate said means for perforating said casing,
   (ii) close said lower ports, and
   (iii) open said upper ports, E. pumping cement downwardly through said drill pipe and outwardly through said upper ports into the area to be sealed, F. stopping the flow of cement, and G. raising said tool and said means for perforating above the cemented area of the cement in said casing before the cement in said casing is dry.

19. The method of claim 18 wherein drilling fluid is pumped downwardly through said drill pipe and outwardly through said lower ports prior to sealing said upper end of said sliding sleeve.

20. The method of claim 18 wherein sealing said upper end of said sliding sleeve is accomplished by dropping a sphere into said drill pipe.

21. The method of claim 18 wherein said tool is lowered to the top of the cement after the cement has dried to determine the depth of the top of the cement.

22. The method of claim 18 wherein pressure is applied to the interior of said casing through said tool above said cement after said cement has dried to determine if said area has been sufficiently cemented.

23. A firing device for a tubing perforating gun affixed to the end of an oil well work string, comprising:

a. a tool body having a cylindrical wall portion defining therewithin a longitudinal bore for conveying fluid flow through the tool body between its end portions;

b. first connection means at the upper end of said tool body for attaching said tool body to the lower end portion of a work string;

c. a firing pin having a pin bore, allowing circulating fluids to pass therethrough, and being movably mounted within said bore between first normal and second firing positions;

d. a detonatable cartridge assembly mounted within said tool body generally below said firing pin; and e. means responsive to an increase of fluid pressure to a level above the hydrostatic pressure within said bore, for moving said firing pin from said first normal position, to said second firing position, detonating said cartridges, said means comprising in part a valving member removably sealably positionable upon said tool body at said bore, for closing said pin bore.

24. A method for perforating a section of well casing comprising the steps of:

a. providing a tool body having an outer wall and inner bore attached at its upper end portion to the end of a work string;

b. providing a movable firing pin having a longitudinal open ended bore within the tool body;

c. securing said tool body and said firing pin in a first normal position which allows fluid circulation through both the tool body and the firing pin;

d. dropping a valving member into said work string until it seals the firing pin bore;

e. increasing fluid pressure within the work string to urge the valving member and firing pin downwardly; and f. firing a perforating gun responsive to the movement of the firing pin from the first normal position to a second firing position.

* * * * *

UNITED STATES PATENT AND TRADEMARK OFFICE

CERTIFICATE OF CORRECTION

PATENT NO. : 4,709,760

DATED : December 1, 1987

INVENTOR(S) : Wilmer W. Crist and Daniel Firmin

It is certified that error appears in the above-identified patent and that said Letters Patent is hereby corrected as shown below:

The title page should be deleted to appear as per attached title page.

Signed and Sealed this

Twenty-fourth Day of May, 1988

*Attest:*

*Attesting Officer*

DONALD J. QUIGG

*Commissioner of Patents and Trademarks*

United States Patent [19]

Crist et al.

[11] Patent Number: 4,709,760

[45] Date of Patent: Dec. 1, 1987

[54] CEMENTING TOOL

[76] Inventors: Wilmer W. Crist, 110 Teche Dr.; Dan Firmin, 215 Camelia Blvd., both of Lafayette, La. 70503

[21] Appl. No.: 314,356

[22] Filed: Oct. 23, 1981

[51] Int. Cl.[4] ..... E21B 43/11; E21B 33/13

[52] U.S. Cl. ..... 166/285; 166/55.1; 166/297; 166/317; 175/4.54

[58] Field of Search ..... 166/55.1, 55, 63, 297, 166/295, 289, 154, 155, 156, 317, 318, 253; 175/4.56, 4.54; 102/319

[56] References Cited

U.S. PATENT DOCUMENTS

| | | | |
|---|---|---|---|
| 1,941,406 | 12/1933 | Manning | 166/154 |
| 2,169,568 | 8/1939 | Morrisett | 166/154 |
| 2,749,840 | 6/1956 | Babcock | 175/4.6 |
| 2,760,408 | 8/1956 | Taylor | 175/4.54 |
| 3,713,490 | 1/1973 | Watson | 166/318 |
| 4,499,951 | 2/1985 | Vann | 166/297 |

*Primary Examiner*—James A. Leppink
*Assistant Examiner*—Hoang C. Dang
*Attorney, Agent, or Firm*—David L. Ray

[57] ABSTRACT

A method and apparatus for cementing an oil or gas well casing including a tubular body section for placing in an oil or gas well casing, the tubular body section being connectable at its upper end to a string of drill pipe and at its lower end to a perforating gun, the tubular body section having a hollow interior, a plurality of upper ports, and a plurality of lower ports, a sliding sleeve located inside the tubular body section adapted to permit drilling fluids to be pumped therethrough and out of the lower ports and to slide downwardly in response to pressure applied to the interior of the string of drill pipe when a seal is placed in contact with the sliding sleeve and thereby activate the perforating gun to perforate the casing, close the lower ports, and open the upper ports to permit cement or other fluids to be pumped outwardly through the upper ports.

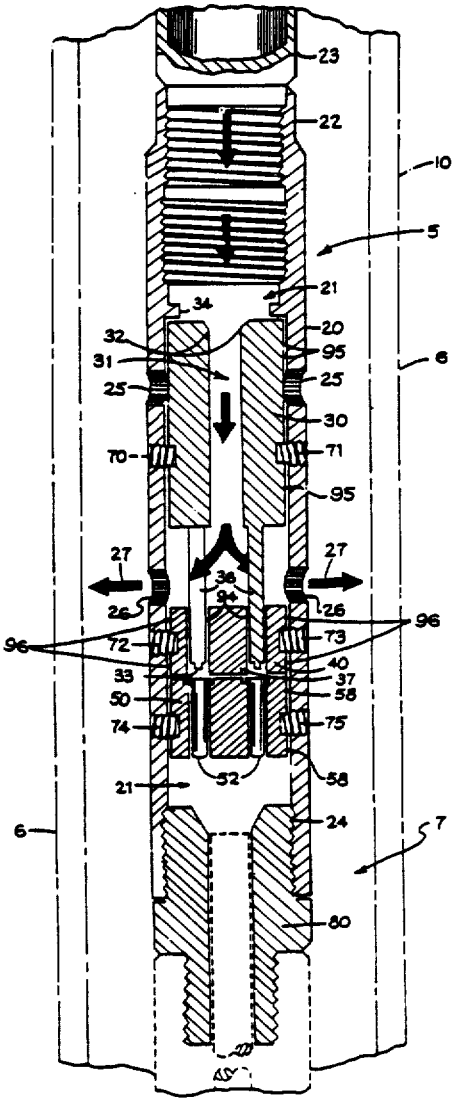

24 Claims, 3 Drawing Figures